US010786042B2

(12) United States Patent
Heidel

(10) Patent No.: US 10,786,042 B2
(45) Date of Patent: Sep. 29, 2020

(54) STRING LASTING

(71) Applicant: adidas AG, Herzogenaurach (DE)

(72) Inventor: Olga Heidel, Oberscheinfeld (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 16/025,781

(22) Filed: Jul. 2, 2018

(65) Prior Publication Data

US 2019/0000185 A1 Jan. 3, 2019

(30) Foreign Application Priority Data

Jul. 3, 2017 (DE) ..... 10 2017 211 251

(51) Int. Cl.

| | |
|---|---|
| ***A43D 5/00*** | (2006.01) |
| ***A43D 15/00*** | (2006.01) |
| ***A43D 19/00*** | (2006.01) |
| ***A43D 95/00*** | (2006.01) |
| ***A43D 3/00*** | (2006.01) |
| ***A43D 23/00*** | (2006.01) |
| ***A43B 23/02*** | (2006.01) |

(Continued)

(52) U.S. Cl.

CPC ..... *A43B 23/0245* (2013.01); *A43B 13/04* (2013.01); *A43B 13/181* (2013.01); *A43D 3/02* (2013.01); *A43D 3/022* (2013.01); *A43D 3/023* (2013.01); *A43D 3/025* (2013.01)

(58) Field of Classification Search

CPC ..... A43D 3/02; A43D 3/022; A43D 3/023; A43D 3/024; A43D 3/025

USPC ..... 12/145, 133 R, 107 R, 136 R; 36/46.5

See application file for complete search history.

(56) References Cited

U.S. PATENT DOCUMENTS

| | | | |
|---|---|---|---|
| 1,414,316 | A | 4/1922 | William |
| 1,452,237 | A | 4/1923 | Dentten |

(Continued)

FOREIGN PATENT DOCUMENTS

| | | |
|---|---|---|
| CN | 106263226 | 1/2017 |
| DE | 494483 | 9/1930 |

(Continued)

OTHER PUBLICATIONS

German Patent Application No. 102017211251.4, Office Action dated Feb. 20, 2018, 9 pages (No English translation available. A summary of the Office Action is provided in the Transmittal Letter submitted herewith).

(Continued)

*Primary Examiner* — Jameson D Collier

(74) *Attorney, Agent, or Firm* — Kilpatrick Townsend & Stockton LLP

(57) ABSTRACT

A method of lasting an upper for an article of footwear can include inserting a last in a collapsed state into an upper. The last can include at least two parts movable relative to each other so as to allow the last to be collapsed along a substantially longitudinal direction from an extended state to the collapsed state. The last can also include at least one fastener configured for attaching string and configured to hold string in the collapsed state and in the extended state of the last. The method can further include attaching the upper to the fastener using at least one string and extending the last. For example, the act of extending the last may increase tension in the string in a manner that draws the upper about the last.

24 Claims, 5 Drawing Sheets

(51) Int. Cl.

| | |
|---|---|
| ***A43D 3/02*** | (2006.01) |
| ***A43B 13/04*** | (2006.01) |
| ***A43B 13/18*** | (2006.01) |

(56) References Cited

U.S. PATENT DOCUMENTS

| | | | | | |
|---|---|---|---|---|---|
| 2,878,523 | A | | 5/1959 | Henry | |
| 3,187,358 | A | * | 6/1965 | Roske | A43D 3/022 12/141 |
| 3,249,955 | A | | 5/1966 | Bourassa et al. | |
| 3,302,313 | A | * | 2/1967 | Isaacson | A43D 3/022 36/43 |
| 3,474,475 | A | | 10/1969 | Fisk | |
| 3,570,151 | A | | 3/1971 | Eaton | |
| 3,704,474 | A | | 12/1972 | Winkler | |
| 3,744,074 | A | * | 7/1973 | Stapleton | A43D 3/022 12/145 |
| 4,027,406 | A | | 6/1977 | Salvatore | |
| 5,152,025 | A | | 10/1992 | Hirmas et al. | |
| 8,595,878 | B2 | | 12/2013 | Farris et al. | |
| 9,445,649 | B2 | | 9/2016 | Huffa et al. | |
| 9,578,928 | B2 | | 2/2017 | Farris | |
| 10,294,591 | B2 | | 5/2019 | Podhajny et al. | |
| 10,321,739 | B2 | | 6/2019 | Farris | |
| 2001/0055684 | A1 | | 12/2001 | Davis et al. | |
| 2017/0143076 | A1 | | 5/2017 | Farris | |
| 2018/0271214 | A1 | | 9/2018 | Farris et al. | |
| 2019/0298000 | A1 | | 10/2019 | Farris | |

FOREIGN PATENT DOCUMENTS

| | | | | |
|---|---|---|---|---|
| DE | 2209870 | | 2/1973 | |
| EP | 2932866 | | 10/2015 | |
| GB | 1454518 | A * | 11/1976 | A43D 3/022 |
| GB | 2095974 | | 10/1982 | |
| JP | H686702 | | 3/1994 | |
| WO | 2016154308 | | 9/2016 | |

OTHER PUBLICATIONS

European Patent Application No. 18181084.7, European Search Report dated Dec. 3, 2018, 9 pages.

German Patent Application No. 102017211251.4, Office Action dated Feb. 20, 2018, 21 pages (English machine translation attached).

German Patent Application No. 102017211251.4, Office Action, dated Aug. 23, 2019, 12 pages (includes English machine translation).

Japanese Patent Application No. 2018-126285, Office Action dated Sep. 24, 2019, 11 pages (includes English machine translation).

* cited by examiner

STRING LASTING

CROSS REFERENCE TO RELATED APPLICATION

This application is related to and claims priority benefits from German Patent Application No. DE 10 2017 211 251.4, filed on Jul. 3, 2017, entitled "String Lasting" ("the '251 application"). The '251 application is hereby incorporated herein in its entirety by this reference.

FIELD OF THE INVENTION

The present invention relates to a lasting an upper for an article of footwear.

BACKGROUND

The lasting of an upper is a crucial step in the production of an article of footwear, in particular a shoe. The method of lasting determines not only the efficiency of the lasting step in terms of the resources, time, and skill required, but also the fit, performance, weight, and comfort of the resulting article of footwear. Today, three main methods of lasting a shoe exist: board-lasting, lasting of a sewn upper, and string lasting. Even nowadays this important step in forming an article of footwear is done manually and has not been automated significantly.

In board lasting, an upper is lasted together with an insole board. This is often the method of choice for cleated footwear or other footwear requiring a strong sole because the resulting shoe may be stable and durable, but consequently it is also heavy. Automatization of board lasting is challenging and thus the process is time consuming and requires skilled labor.

Therefore, an upper is often sewn to an additional insole sheet using a Strobel sewing machine and this insole sheet is then attached to the sole by an adhesive. The resulting shoe is more lightweight than a board-lasted shoe. However, this process usually requires at least three steps: pre-forming the upper, sewing the insole sheet to the upper, lasting the upper. This process cannot be automated easily and as a consequence, it is time-consuming and costly and thus cannot usually be performed in proximity to a customer, such as at a store.

In conventional string lasting, a string is bound to the edge of the lasting margin of an upper to enable lasting of the upper by pulling on the ends of the string.

U.S. Pat. No. 3,704,474 describes a method of shoe making which comprises placing an insole on the bottom of a last, string-lasting an upper onto the last over the exposed face of the insole while holding the inner side of the lasting margin spaced from the edge face of the insole, and thereafter forming an outsole against the insole and lasting margin of the upper by injection molding.

U.S. Pat. No. 3,570,151 discloses an upper having a string loosely bound to the edge of its lasting margin to enable shortening the edge by pulling on the ends of the string to effect lasting of the upper to a shoe form, and a loop extending across the upper from one side to the other at substantially the shank to effect drawing the sides of the upper at the shank toward each other.

U.S. Pat. No. 3,249,955 describes string-lasting of the upper to the bottom of a shoe in which a bottom part, such as a tuck or shank piece, is to be incorporated. This is achieved by providing a part with means along the opposite longitudinal edges which project downwardly therefrom, placing the part against the bottom of the last with its edges beneath the lasting margin, and looping loops of the string-lasting about the downwardly projecting means.

U.S. Pat. No. 4,027,406 discloses a method comprising attaching a lasting piece of shrinkable, preferably oriented thermoplastic polymeric material, preferably by stitching, to a shoe upper lasting margin. Shrinkage of the lasting piece lasts the shoe upper to the last. The lasting piece may be a lasting string, endless band or strip, or a sheet, web, net, or welt.

U.S. Pat. No. 2,878,523 discloses a method of making footwear comprising the steps of holding the lower margin of an upper, which has been mounted on a last, with the margin disposed inwardly against the bottom, between the marginal edge of the bottom of the last and the marginal portion of an uncured sole blank, and vulcanizing the uncured sole blank to the margin of the upper.

However, the presently available methods of string lasting are mechanically complex and require careful manipulation of the lasting strings. As a consequence, they only allow a limited extent of automation of the string lasting process. U.S. Pat. No. 3,474,475, for example, discloses an apparatus for providing power assistance in string lasting footwear uppers. The apparatus includes two power operated mechanical arms which retain opposite ends of a lasting string and cooperate to pull the string taut, whereby to last an upper on a footform.

Collapsible lasts are known in the prior art in order to facilitate an easier removal of the last from the upper after the lasting is completed or to hold the upper in place during the lasting operation. However, collapsible lasts are not used in a dynamic manner in order to facilitate the lasting operation itself.

U.S. Pat. No. 1,414,316 discloses a shoe last comprising a toe section, a heel section pivotally secured to the toe section and having a passage extending from its front to its rear end and a flexible pin having one end secured to the rear end of the toe section at a point directly beneath and spaced from the pivotal connection and adapted to lie, within the passage, whereby, when the sections are in normal position, the free end of the pin will be projected beyond the outer end of the heel section and retracted when the sections are moved relatively upon their pivot.

U.S. Pat. No. 1,452,237 discloses a shoe last including relatively adjustable toe and heel sections, the heel section having a longitudinal way formed in its lower portion, and a catch of a length greater than the heel section slidable in said way having its inner end normally extended beyond the inner end of the heel section adapted to have abutting engagement with an adjacent portion of the toe section.

An objective of the present invention may be to provide a simpler method of string lasting an upper which may be automated more easily than existing methods. A resulting article of footwear, in particular a shoe, may be faster and more cost effective to produce than existing shoes. This would allow a production closer to the customer which may allow more individualized shoes to be produced due to much shorter turnaround cycles.

A further disadvantage of traditional board lasted footwear or footwear with a sewn upper is that the fit, especially in the toe and heel region is often not ideal due to the lasting board in board lasting or the insole sheet used to glue a sewn upper to the sole. A further objective of the present invention may therefore be to provide a lightweight article of footwear with an improved fit in the toe and heel region.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a method may include inserting a last in a collapsed state into an upper. The last may include at least two parts movable relative to each other so as to allow the last to be collapsed along a substantially longitudinal direction from an extended state to the collapsed state. The last may include at least one fastener configured for attaching string and configured to hold string in the collapsed state and in the extended state of the last. The method may further include attaching the upper to the fastener using at least one string. The method further may include extending the last.

In some embodiments, the attaching is performed before the extending.

In some embodiments, the attaching includes attaching the at least one string to the upper in such a way that the at least one string is under tension when the last is in the extended state.

In some embodiments, the upper includes at least one gap on a bottom portion of the upper. The upper may further include a bridge connecting a left side and a right side of the upper on the bottom portion of the upper, thereby bridging the gap. The bridge may be formed by a sheet of material.

In some embodiments, the upper further includes a channel located in a rim portion around the gap with at least two openings to the channel configured in such a way as to allow the at least one string to be inserted into the channel and pulled through the channel along the length of the channel.

In some embodiments, the method further includes arranging the upper on the last in a tight and formfitting manner by pulling the at least one string.

In some embodiments, the extending the last increases an amount of tension in the at least one string so as to draw the upper about the last.

In some embodiments, the method further includes forming a margin with the upper on a lower side of the last. The margin may extend at least 5 mm from a rim of the last at any position around the rim.

In some embodiments, the method is performed in an automated fashion. In some embodiments, the automation includes handling at least one of the last or the upper with a robot arm. The action of the robot arm may be based on information gained from a visual control system including at least one camera.

In some embodiments, the method further includes providing a sole element and attaching the sole element to the upper.

In some embodiments, the sole element forms substantially the entire sole of the article of footwear.

In some embodiments, the providing the sole element and the attaching the sole element to the upper include: injecting a substantially liquid component into a form; attaching said form to the upper; and curing the component.

In some embodiments, the substantially liquid component includes thermoplastic polyurethane.

In some embodiments, the sole element includes a cushioning element including a plurality of randomly arranged particles of an expanded material. In some embodiments, the sole element is attached to the upper by welding. In some embodiments, the sole element is attached to the upper by an adhesive.

In some embodiments, the sole element is at least one of a cushioning element or a midsole element. The method may further include attaching an outsole to the sole element.

According to certain embodiments of the present invention, a collapsible last includes at least two parts movable relative to each other along a substantially longitudinal direction so as to allow the last to be collapsed along the substantially longitudinal direction to a collapsed state of the last from an extended state of the last. The collapsible last may further include at least one fastener configured for attaching string and configured to hold the string in the collapsed state of the last and in the extended state of the last.

In some embodiments, the last includes a hinge to facilitate movement between the collapsed state and the extended state.

In some embodiments, the last includes at least two fasteners.

In some embodiments, at least one fastener is arranged on each part of the last.

In some embodiments, the fastener includes a hook or a pin.

In some embodiments, the last includes a non-stick portion on a bottom surface of the last.

In some embodiments, the fastener is arranged on the last in such a way that the fastener does not protrude from the surface of the last.

In some embodiments, the last is collapsible along a longitudinal direction so as to reduce a length of the last by at least 3 cm.

According to certain embodiments of the present invention, an upper includes a left side of the upper; a right side of the upper; a bottom portion of the upper; a gap on the bottom portion of the upper; and a bridge connecting the left side and the right side of the upper on the bottom portion of the upper, thereby bridging the gap. The bridge may be formed by a sheet of material.

In some embodiments, the upper further includes a channel around the gap with at least two openings to the channel configured in such a way as to allow a string to be inserted into the channel and pulled through the channel along the length of the channel.

In some embodiments, the upper further includes a string that is incorporated into a rim portion around the gap on the bottom portion of the upper.

BRIEF DESCRIPTION OF THE DRAWINGS

In the following detailed description, embodiments of the invention are described referring to the following figures.

BRIEF DESCRIPTION

Figure 1:
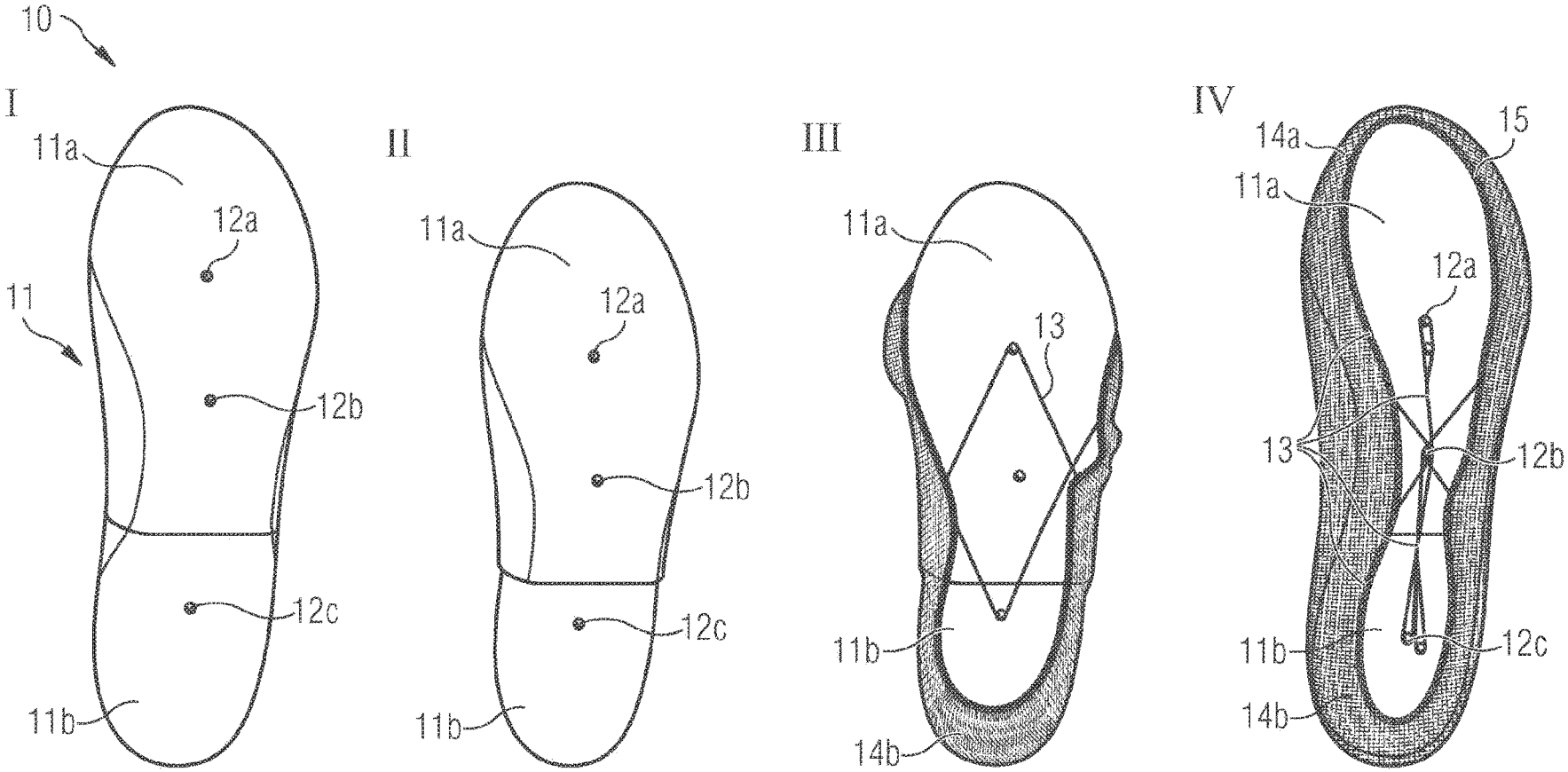
FIG. 1 depicts an example of a method of lasting an upper according to some embodiments.

The objectives described above may be solved by a method of lasting an upper for an article of footwear, including: (a) providing a last, where the last includes at least two parts that may be moved relative to each other so as to allow the last to be collapsed along a substantially longitudinal direction, and where the last includes at least one fastener (or other means for attaching a string) configured to hold the string in a collapsed and in an extended state of the last; (b) providing an upper; (c) inserting the collapsed last into the upper; (d) attaching the upper to the fastener or other means for attaching a string using at least one string; and (e) extending the last.

The two parts of the last may be permanently connected, however it is also possible that the two parts of the last are not connected. Permanently connected in this context may signify connected is such a way as to not be disconnected during normal use of the last.

A longitudinal direction may signify the direction of greatest linear extent between the toe end of the last and the heel end of the last, in a plane parallel to the lower contact surface of the last. A substantially longitudinal direction may be a direction that extends between the toe end of the last and the heel end of the last along the longitudinal direction but allowing for deviations due to manufacturing imperfections or manufacturing constraints of up to 45 degrees in a sideways direction, that is, in the plane parallel to the lower contact surface of the last. A substantially longitudinal direction may also be directed by an angle of up to 60 degrees (for example, the angle may be 45 degrees) in a vertical direction along the shaft of the last.

The string may be attached to the fastener or other means for attaching a string by any suitable method or technique, for example, by tying a knot in the string. It is also possible to manufacture strings with additional fasteners or other additional attachment means such as hooks or eyelets in order to simplify the attachment. Attaching in this context may signify that the string will withstand a pulling force (e.g., of at least 1 N), without detaching. Attaching the string to the fastener or other means for attaching a string may be performed before step (e) or after step (e) in which the last is extended.

This method may be beneficial in that an upper may be lasted with a particularly good and tight fit to the last because the string distributes a formfitting tension uniformly onto the upper. In board lasting, the fit to the wearer's foot is often poor close to the rim of the sole as the lasting board prevents a tight fit of the upper to the wearer's foot. A similar problem exists when an upper is sewn to an insole sheet, for example by a Strobel sewing machine. As a consequence, wrinkles can form in the upper around its rim and the wearing comfort and support for the foot is limited, especially in the toe and heel region.

In conventional string lasting, some of these disadvantages may be overcome since the upper may be pulled for a close fit by the lasting strings. However, conventional string lasting cannot easily be automated as the strings have to be pulled in a coordinated fashion to last the upper. This is typically done manually, requires skill and is thus labor intensive and leads to a variation in the quality of lasting. In the present method, lasting may be simplified by the dynamic extension of the last which allows the upper to be fitted around it by making use of the motion of extending the last. In some embodiments, it may be beneficial to use an elastic upper that is manufactured to be larger than the last when the last is collapsed but smaller than the last when the last is extended. Thus, the upper may be conveniently arranged on the collapsed last and as the last is extended, a tension develops in the upper and the upper is easily lasted on the last. As a further consequence, the quality of the fit of the upper on the last is improved. Another possible benefit of this method is that it may be automated more easily than conventional methods.

Step (d) may be performed before step (e). That is, the string may be attached to the fastener or other means for attaching a string, before the last is extended. Thus, when the last is extended, the strings are pulled and cause the upper to be lasted. Thus, lasting is primarily effected by extending the collapsed last rather than manually. This operation is simpler, more reproducible and requires less manual finesse than conventional string lasting and it can therefore be automated more easily. However, the process does not have to be automated; benefits of greater simplicity, reproducibility, and thus faster execution of lasting an upper may remain also if the process is carried out by a human worker.

The string may be attached to the upper in step (d) in such a way that it is under tension when the last is in an extended state. That is, the string may already be under tension when the last is in a collapsed state. Alternatively, the string may not be under tension when the last is in a collapsed state and the operation of extending the last may cause tension to develop in the string. The tension in the string causes the string to pull on the upper and improve the lasting of the upper by pulling the upper into a tight fit on the last.

The upper may include at least one gap on a bottom portion of the upper. This way the weight of the upper is reduced, leading to a lower weight of the resulting article of footwear.

The upper may further include a bridge connecting a left side and a right side of the upper on the bottom portion of the upper, thereby bridging the gap. The bridge may be formed by a sheet of material. The purpose of the bridge is to pull together the left and right opposite parts of the upper. This is particularly important in a concave region of the upper, such as the midfoot region, where a tight fit of the upper to the last is otherwise difficult to achieve. Lasting of the upper is improved, if the bridge is made from a sheet of material rather than a single string or a plurality of strings. In particular, the connection between the two opposite sides is stronger if the bridge is made from a sheet of material rather than a single string or a plurality of strings. Furthermore, the bridge may be sewn into the upper quickly in a process that can easily be automated. The bridge may be especially useful if only a single fastener or other means for attaching a string is present on the last.

The upper may further include a channel located in a rim portion around the gap with at least two openings to the channel configured in such a way as to allow a string to be inserted into the channel and pulled through the channel along the length of the channel. This way, tension may be transmitted by the string uniformly along the length of the channel, which allows a particularly good fit of the upper to the last to be achieved. The channel may be arranged substantially along the whole length of a rim around the gap of the upper. Substantially along the whole length of the rim around the gap of the upper in this context may signify along the whole length of the rim around the gap of the upper but excluding the space around the openings to insert a string. The space may be sufficiently large to insert and remove a string, e.g. using a needle attached to the string. Alternatively, the channel may also be arranged on only a portion of the rim around the gap of the upper. For example, the channel may only cover substantially the length of a first part of the rim around the gap of the upper which is arranged on the first part of the last. Substantially the length of a first part of the rim around the gap of the upper in this context may signify at least 50% of the length of the rim of a first part of the upper.

In some embodiments, the openings to insert the string into the channel are in a midfoot region of the upper. The midfoot region of the last typically has a concave shape. This arrangement therefore allows for the opposite sides of the upper to be pulled together in the concave midfoot region in order to achieve a good fit of the upper to the last.

The method may further include arranging the upper on the last in a tight and formfitting manner by pulling the string. While the lasting is primarily effected by extending the last, some fine adjustment may be required. This is easily and effectively done by pulling the string as the string exerts a uniform tension on the last. If the string contains an additional fastener (such as a hook, eyelet, or other attachment means), this additional fastener may need to be readjusted. Additional manual adjustment around the rim of the upper is then only necessary in exceptional cases.

The method may further include forming a margin with the upper on the lower side of the last. Forming a margin with the upper on the lower side of the last provides some additional stability during the lasting process and in particular it allows for a strong bond to be formed with a sole element that may be attached to the lasted upper in order to form an article of footwear.

The margin may extend at least 5 mm from the rim of the last at any position around the rim. A margin of at least 5 mm provides for a sufficiently strong bond between the lasted upper and a sole element in order to form a stable article of footwear. For particularly demanding applications, the margin may extend at least 10-12 mm from the rim, for example.

The method may be performed in an automated fashion. Automated fashion, may signify that essential steps of the method are performed largely or exclusively without requiring human interaction. It is possible to automate any or all of the steps according to the method. In particular, it is possible to automate (a) providing a last, wherein the last includes at least two parts that may be moved relative to each other such as to allow the last to be collapsed along a substantially longitudinal direction, wherein the last includes at least one fastener or other means for attaching a string; (b) providing an upper; (c) inserting the collapsed last into the upper; (d) attaching the upper to the fastener or other means for attaching a string using at least one string; and (e) extending the last. The method may be performed with greater reproducibility than if it were performed by a human worker. The production speeds may be increased and a production facility may be run 24 hours a day, 365 days a year, excluding time for necessary maintenance. Since the cost of the production is reduced, production may be performed closer to the customer. This allows shorter turnaround time scales and thus a greater extent of customization of the manufactured products.

The automation may include handling the last and/or the upper with a robot arm. A robot arm allows for a great extent of control, e.g., sufficient to perform any or all of the steps of the method. In case of unexpected problems, the automated control of the robot arm could be paused and the robot arm could be controlled by a technician.

The action of the robot arm may be based on information gained from a visual control system including at least one camera. Visual feedback obtained via a camera is a simple, accurate, and cost-effective way to provide control information required to steer an operation performed, for example, by a robot arm. It is particularly suitable to the method as the parts that require handling are visible during the method.

The technique for collapsing the last may involve the use of a hinge. A hinge may firmly and permanently connect the at least two parts of the last. A hinge is a simple and effective device for allowing movement of the two parts relative to each other. This allows for good stability of the last. Furthermore, the hinge provides a guiding piece that simplifies extending and collapsing the last, which makes automation of this method easier and simplifies the method for a human worker, if it is performed by a human worker.

The last may include at least two fasteners or other means for attaching a string. By providing two fasteners or other means for attaching a string, a string may be attached at several positions on the last, thus improving the fit of the upper on the last.

At least one fastener or other means for attaching a string may be arranged on each part of the last. In some embodiments, strings originating from one side of the upper are attached at fasteners or other means for attaching a string at an opposite side of the last. Thus, by having at least one fastener or other means for attaching a string arranged on each part of the last, it is possible to attach each string at an opposite side of the last in order to improve the fit of the upper on the last.

The fastener on the last may include a hook, a pin, or other means for attaching a string. A hook or a pin may be useful and inexpensive options for attaching a string quickly. Furthermore, when a sole element is attached to the lasted upper, the string may be removed from a pin or a hook at that stage in a simple and fast manner, without needing to cut the string, which would risk damaging the upper.

The fastener or other means for attaching a string may be arranged on the last in such a way that it does not protrude from the surface of the last. For example, the fastener or other means for attaching a string may be arranged in a recess on the surface of the last. This may be beneficial in that the attachment of a sole element after lasting the upper may be improved. In particular, a protruding fastener or other means for attaching a string may damage the sole element or cause a hole in a sole element formed in injection molding directly onto the lasted upper.

In some embodiments, the last could be collapsed along a longitudinal direction such as to reduce its length by at least 3 cm. By reducing the length of the last by at least 3 cm, it is easy to insert the last into the upper and a sufficient amount of tension may be developed when the last is extended. In some embodiments, the length of the last may be reduced by at least 5 cm, allowing an easier insertion of the last into the upper and a greater amount of lasting tension to be developed.

Some embodiments further concern a method of producing an article of footwear, including: (a) providing a lasted upper as specified herein, (b) providing a sole element, and (c) attaching the sole element to the upper. The resulting footwear may be very lightweight as the upper may be directly attached to the sole element, without requiring a lasting board as in board lasting or an insole sheet as required when a sewn upper (sometimes also referred to as a "strobelled" upper) is glued into a sole. The sole element could be a midsole or an outsole. The sole element may be directly visible in the inside of the article of footwear, that is, the sole element may be in direct contact with a wearer's foot. This also allows for interesting design effects. Since an additional insole element may be superfluous in some embodiments, the construction of said article of footwear may also be greatly simplified. Furthermore, the breathability of the article of footwear may be improved as less material is required to support the sole construction.

The sole element may form substantially the entire sole of the article of footwear. Substantially the entire sole may signify the sole without additional support elements such as torsion bars, or attachments for straps or laces, spikes, etc. In this case, the article of footwear may be particularly light and its production is particularly simple.

The steps (b) providing a sole element, and (c) attaching the sole element to the upper may include injecting a substantially liquid component into a form, attaching said form to the lasted upper, and curing the component. In this way, an adhesive-free attachment of the sole element may be achieved as the sole is formed directly on the upper. The bond between the upper may be particularly strong and waterproof as the liquid component flows to fill even small gaps. The resulting article of footwear may thus be especially durable and waterproof.

The substantially liquid component may include thermoplastic polyurethane. Thermoplastic polyurethane has excellent material properties for making a strong, yet comfortable and cushioning sole element. It also may be treated easily in an injection molding process.

The sole element may include a cushioning element including a plurality of randomly arranged particles of an expanded material. A sole element including a plurality of randomly arranged particles of an expanded material provides excellent cushioning and breathability properties as channels are formed between the particles of expanded material through which air and/or a liquid can travel. This type of sole element is particularly suitable to be used with methods of some embodiments, as such methods may allow the sole element to be directly visible in the shoe, that is, the sole element may be in direct contact with a wearer's foot. Therefore, the wearing comfort due to the lightweight construction, the cushioning properties and the breathability is greatly improved. The cushioning element may further include a reinforcing element provided as a foil including thermoplastic urethane. The foil may include at least one opening which is arranged in such a way that air and/or a liquid passing through the at least one channel between the particles of expanded material can pass in at least one direction through the at least one opening in the foil. This arrangement allows both the stability of the sole element to be improved and allows the breathability to be controlled and improved. For example, the sole element may be designed to be impermeable to water from the ground but to let moisture pass through the sole from a wearer's foot.

The sole element may be attached to the upper by welding. Welding, for example infrared welding, allows a sole element to be attached without the use of additional adhesives. Therefore, the environmental impact of the production process is improved. Furthermore, since the seal is made directly between the material of the sole element and the upper, the seal is waterproof, long-lasting, and does not affect the properties of the sole element as, for example, a hardened adhesive might do.

The sole element may be attached to the upper by an adhesive. The adhesive, or glue, may include a contact cement, an epoxy based resin, a hot melt glue, or polyvinyl acetate or any other suitable adhesive material. An adhesive allows for a simple attachment and may be used also when the material of the sole element or the upper is not suitable for welding.

The surface of the last may be treated with a non-stick substance. This allows the last to be removed easily from the upper, after attaching the upper to the sole element. The non-stick substance should be suitable for the technique of attaching the sole element. For example, oil-based substances, grease, or substances including polytetrafluoroethylene (PTFE) or substances including silicone, also known as polysiloxane, are suitable for preventing many adhesives, such as polyvinyl acetate, contact cement, or epoxy from sticking to the surface of the last.

The sole element may be a cushioning element and/or a midsole element and the method in some embodiments may further include the additional step of attaching an outsole to the sole element. Thus, the sole element may provide cushioning and comfort to the wearer and the outsole may provide the necessary protection to the sole element from wear and tear.

Some embodiments further concern an article of footwear, produced according to the method of producing an article of footwear as outlined herein.

Some embodiments further concern a collapsible last. For example, the collapsible last may include (a) at least two parts, that may be moved relative to each other along a substantially longitudinal direction such as to allow the last to be collapsed along the substantially longitudinal direction and (b) at least one fastener or other means for attaching a string configured to hold the string in a collapsed and in an extended state of the last. The two parts of the last may be permanently connected, however it is also possible that the two parts of the last are not connected. Permanently connected in this context may signify connected in such a way as to not be disconnected during normal use of the last.

The technique for collapsing the last may involve the use of a hinge. A hinge may firmly and permanently connect the at least two parts of the last. A hinge is a simple and effective device for allowing movement of the two parts relative to each other. This allows for good stability of the last. Furthermore, the hinge provides a guiding piece that simplifies extending and collapsing the last, which makes automation of this method easier and simplifies the method for a human worker, if it is performed by a human worker.

The last may include at least two fasteners or other means for attaching a string. By providing two fasteners or other means for attaching a string, a string may be attached at several positions on the last thus improving the fit of the upper on the last.

The at least one fastener or other means for attaching a string may be arranged on each part of the last. In some embodiments, strings originating from one side of the upper are attached at fasteners or other means for attaching a string at an opposite side of the last. Thus, by having at least one fastener or other means for attaching a string arranged on each part of the last, it is possible to attach each string at an opposite side of the last in order to improve the fit of the upper on the last.

The fastener on the last may include a hook, a pin, or other means for attaching a string. A hook or a pin may be useful and inexpensive options for attaching a string quickly. Furthermore, when a sole element is attached to the lasted upper, the string may be removed from a pin or a hook at that stage in a simple and fast manner, without needing to cut the string, which would risk damaging the upper.

The last may include a non-stick portion on its bottom surface. This allows the last to be removed easily from the upper, after attaching the upper to the sole element. The non-stick portion should be suitable for the technique of attaching the sole element. For example, a portion of the bottom surface coated with polytetrafluoroethylene (PTFE) is suitable for preventing many adhesives, such as polyvinyl acetate, contact cement, or epoxy from sticking to the surface of the last.

The fastener or other means for attaching a string may be arranged on the last in such a way that it does not protrude from the surface of the last. For example, the fastener or other means for attaching a string may be arranged in a recess on the surface of the last. This may be beneficial in that the attachment of a sole element after lasting the upper may be improved. In particular, a protruding fastener or other means for attaching a string may damage the sole element or cause a hole in a sole element formed in injection molding directly onto the lasted upper.

Some embodiments further concern an upper including at least one gap on a bottom portion of the upper. The upper may further include a bridge connecting a left side and a right side of the upper on the bottom portion of the upper, thereby bridging the gap. The bridge may be formed by a sheet of material. The purpose of the bridge is to pull together the left and right opposite parts of the upper. This is particularly important in a concave region of the upper, such as the midfoot region, where a tight fit of the upper to the last is otherwise difficult to achieve. Lasting of the upper is improved, if the bridge is made from a sheet of material rather than a single string or a plurality of strings. In particular, the connection between the two opposite sides is stronger if the bridge is made from a sheet of material rather than a single string or a plurality of strings. Furthermore, the bridge may be sewn into the upper quickly in a process that can easily be automated. The bridge may be especially useful when only a single fastener or other means for attaching a string is present on the last.

The upper may further include a channel around located in a rim portion around the gap with at least two openings to the channel configured in such a way as to allow a string to be inserted into the channel and pulled through the channel along the length of the channel. This way, tension may be transmitted by the string uniformly along the length of the channel which allows a particularly good fit of the upper to the last to be achieved. The channel may be arranged substantially along the whole length of a rim around the gap of the upper. Substantially along the whole length of the rim around the gap of the upper in this context may signify along the whole length of the rim around the gap of the upper but excluding the space around the openings to insert a string. The space may be sufficiently large to insert and remove a string, e.g. using a needle attached to the string. Alternatively, the channel may also be arranged on only a portion of the rim around the gap of the upper. For example, the channel may only cover substantially the length of a first part of the rim around the gap of the upper which is arranged on the first part of the last. Substantially the length of a first part of the rim around the gap of the upper in this context may signify at least 50% of the length of the rim of a first part of the upper.

In some embodiments, the openings to insert the string into the channel are in a midfoot region of the upper. The midfoot region of the last typically has a concave shape. This arrangement therefore allows for the opposite sides of the upper to be pulled together in the concave midfoot region in order to achieve a good fit of the upper to the last.

In some embodiments, the upper may include a string that is incorporated into a rim portion around the gap on the bottom portion of the upper. Incorporating the string into a rim portion of the upper may be simpler and faster than inserting the string into a channel, especially for a knitted upper, and thus reduce the time required for lasting the upper. Incorporating the string into a rim portion of the upper in this context may signify that the yarn is not placed in a channel, as described herein, after forming said channel. Though the string is incorporated into the upper, it may still be possible to move the string relative to the upper by pulling on the string. For some methods of producing the upper, it is possible to incorporate such a string into the upper directly when the upper is being manufactured. For example, the string may be incorporated as a filler yarn in warp knitting or weft knitting.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following only some possible embodiments of the invention are described in detail. The person skilled in the art is aware that these possible embodiments may be modified in a number of ways and combined with each other whenever compatible and that certain features may be omitted in so far as they appear dispensable.

While the embodiments below are described primarily with reference to a shoe, the skilled person will recognize that methods according to the invention, lasts according to the invention, and uppers according to the invention, can equally be applied in the production of any article of footwear, in particular to socks, for-example, socks including a non-slip bottom surface, sandals, slippers, etc.

FIG. 1 shows an example of a method 10 of lasting an upper for an article of footwear according to some embodiments.

In step I, the extended last 11 (including three fasteners 12 for attaching string) is shown. While the last shown in FIG. 1 includes three fasteners 12, some embodiments may utilize as few as a single fastener. It is to be understood that the last 11 could include any number of fasteners so long as it contains at least one fastener. In the arrangement depicted in FIG. 1, the fastener is a small pin on the surface of the last. However, any structure suitable for attaching a string to the last could be used, including, but not limited to a pin, a hook, or other means for attaching a string by any suitable method or technique. The fastener may be configured to hold the string both in a collapsed and an extended state of the last. The fastener may also be arranged on the last in such a way as to not protrude from the last. For example, the fastener may be arranged in a recess on the surface of the last. The depicted last in FIG. 1 further includes two connected parts 11*a* and 11*b* that may be moved relative to each other such as to allow the last to be collapsed along a substantially longitudinal direction.

A longitudinal direction may signify the direction of greatest linear extent between the toe end of the last and the heel end of the last, in a plane parallel to the lower contact surface of the last. A substantially longitudinal direction may be a direction that extends between the toe end of the last and the heel end of the last along the longitudinal direction but allowing for deviations due to manufacturing imperfections or manufacturing constraints of up to 45 degrees in a sideways direction, that is, in the plane parallel to the lower contact surface of the last. A substantially longitudinal direction may also be directed by an angle of up to 60 degrees (for example, the angle may be 45 degrees) in a vertical direction along the shaft of the last.

The last 11 may include a non-stick portion on its bottom surface. This may allow the last to be removed easily from the upper 14, e.g., after attaching the upper 14 to a sole element. The non-stick portion should be suitable for the technique implemented for attaching the sole element. For example, a portion of the bottom surface coated with polytetrafluoroethylene (PTFE) may be suitable for preventing many adhesives (such as polyvinyl acetate, contact cement, or epoxy) from sticking to the surface of the last. Alternatively, the surface of the last may be treated with a non-stick substance. The non-stick substance should be suitable for the technique implemented for attaching the sole element. For example, oil-based substances, grease, or substances including polytetrafluoroethylene (PTFE) or substances including silicone, also known as polysiloxane, are suitable for preventing many adhesives (such as polyvinyl acetate, contact cement, or epoxy) from sticking to the surface of the last.

In step II, the last 11 is collapsed along the substantially longitudinal direction. The operation of collapsing the last 11 is facilitated by a hinge located at the upper side of the last 11 (not shown in FIG. 1) that connects the first part 11*a* and the second part 11*b* of the last. The step of collapsing the last 11 may be automated easily. For example, a robot arm could be used to collapse the last 11. In some embodiments, the length of the last 11 is reduced by at least 3 cm. By reducing the length of the last 11 by at least 3 cm, it is easy to insert the last 11 into the upper 14 and a sufficient amount of tension may be developed when the last 11 is extended. In some embodiments, the length of the last 11 is reduced by at least 5 cm, allowing an easier insertion of the last 11 into the upper 14 and a greater amount of lasting tension to be developed.

In step III, the last 11 is inserted into an upper 14. The upper 14 includes a gap on a bottom portion of the upper 14. The gap reduces the weight of the upper 14 and therefore allows a more lightweight article of footwear to be constructed. The heel region 14*b* of the upper 14 is arranged on a heel portion of the second part 11*b* of the last 11. Strings 13 are used to attach the upper 14 to the fastener(s) 12 on the last. Strings 13 originating from a heel region 14*b* of the upper 14 are attached to the fastener or pin 12*a* on the first part 11*a* of the last and strings 13 originating from a toe region 14*a* of the upper 14 are attached to the fastener or pin 12*c* in the second part 11*b* of the last. In other words, strings 13 originating from one side of the upper 14 are attached at the fastener at the opposite side of the last.

The strings 13 are attached to the upper 14 in such a way that the strings 13 are under tension when the last 11 is in an extended state. The strings 13 may already be under tension when the last 11 is in a collapsed state in step III. Alternatively, the strings 13 may not be under tension when the last 11 is in a collapsed state and the operation of extending the last 11 may cause tension to develop in the strings 13. The tension in the strings 13 causes the strings 13 to pull on the upper 14 and improve the lasting of the upper 14 by pulling the upper 14 into a tight fit on the last 11.

The strings 13 are arranged in a channel 15 sewn into a rim around the gap on the bottom portion of the upper. This way, tension may be transmitted by the string uniformly along the length of the channel which allows a particularly good fit of the upper 14 to the last 11 to be achieved. The channel 15 may be arranged substantially along the whole length of the rim around the gap on the bottom portion of the upper 14. Substantially along the whole length of the rim around the gap on the bottom portion of the upper in this context may signify along the whole length of the rim around the gap on the bottom portion of the upper but excluding the space around the openings to insert a string. The space maybe sufficiently large to insert and remove a string 13, e.g. using a needle attached to the string 13. Alternatively, the channel may also be arranged on only a portion of the rim around the gap on the bottom portion of the upper 14. For example the channel may only cover substantially the length of a first part of the rim around the gap on the bottom portion of the upper 14 which is arranged on the first part 11*a* of the last 11. Substantially the length of a first part of the rim around the gap on the bottom portion the upper 14 in this context may signify at least 50% of the length of the rim around the gap on the bottom portion of a first part of the upper 14.

In some embodiments, the openings to insert the string 13 into the channel 15 are in a midfoot region of the upper 14. Since the midfoot region of the last 11 typically has a concave shape, strings 13 from opposite sides of the upper may be pulled around a fastener or pin 12*c* located between the fasteners or pins 12*a* and 12*b*. This arrangement allows for the opposite sides of the upper 14 to be pulled together in the concave midfoot region. The person skilled in the art will recognize that such fasteners or pins could be used at other locations on the last, especially in concave regions, in order to pull opposite regions of the upper 14 together.

In step IV, the toe region 14*a* of the upper 14 is also loosely fitted around a toe portion in the first part 11*a* of the last 11. The last 11 is then extended by moving the two parts 11*a* and 11*b* relative to each other. Attaching the upper to the fastener may be performed before extending the last. Since the strings 13 are attached to the fastener 13 already in step III, extending the last 11 affects the strings 13 to pull on the upper 14, thus arranging the upper 14 on the last 11 in a tight and formfitting manner. This operation is simpler, more reproducible, and requires less manual finesse than conventional string lasting. It may therefore be automated more easily. This step can therefore be automated easily and could, for example, be performed by a robot arm. However, the process does not have to be automated; benefits of greater simplicity, reproducibility, and thus faster execution of lasting an upper may remain also if the process is carried out by a human worker. Some fine adjustment of the fit of the upper may be performed by pulling on the strings. This could be carried out by a robot arm based on feedback received from a visual control system. A margin remains at the rim of the upper which is used to bond the upper to a sole element. In some embodiments, the margin is 5 mm wide at any point along the rim in order to allow for a strong bond between the upper and the sole element. In some embodiments, the margin is 10-12 mm wide to allow a stronger bond. In either case, the bond is very strong and durable and may be formed with a wide range of materials for the sole element.

Methods of embodiments described herein may allow a lasting process to be automated more easily than with existing methods of lasting an upper. Unlike for a lasted sewn upper, no pre-forming is required. Unlike in board lasting, the labor-intensive process of gluing the upper to a lasting board is not necessary (see the discussion with reference to FIG. 4 below). An upper 14 lasted with methods of embodiments described herein may be attached with the margin formed in step IV to a sole element directly in a subsequent step. The sole element could be the outsole. In this case, the resulting article of footwear would be particularly lightweight. The sole element could also be a midsole or a cushioning element. In some embodiments, the method may permit the sole element to be directly visible on the inside of the shoe. This allows for interesting design possibilities and results in a lightweight article of footwear with good breathability. This is described in more detail with reference to FIGS. 6A and 6B below.

Figure 2:
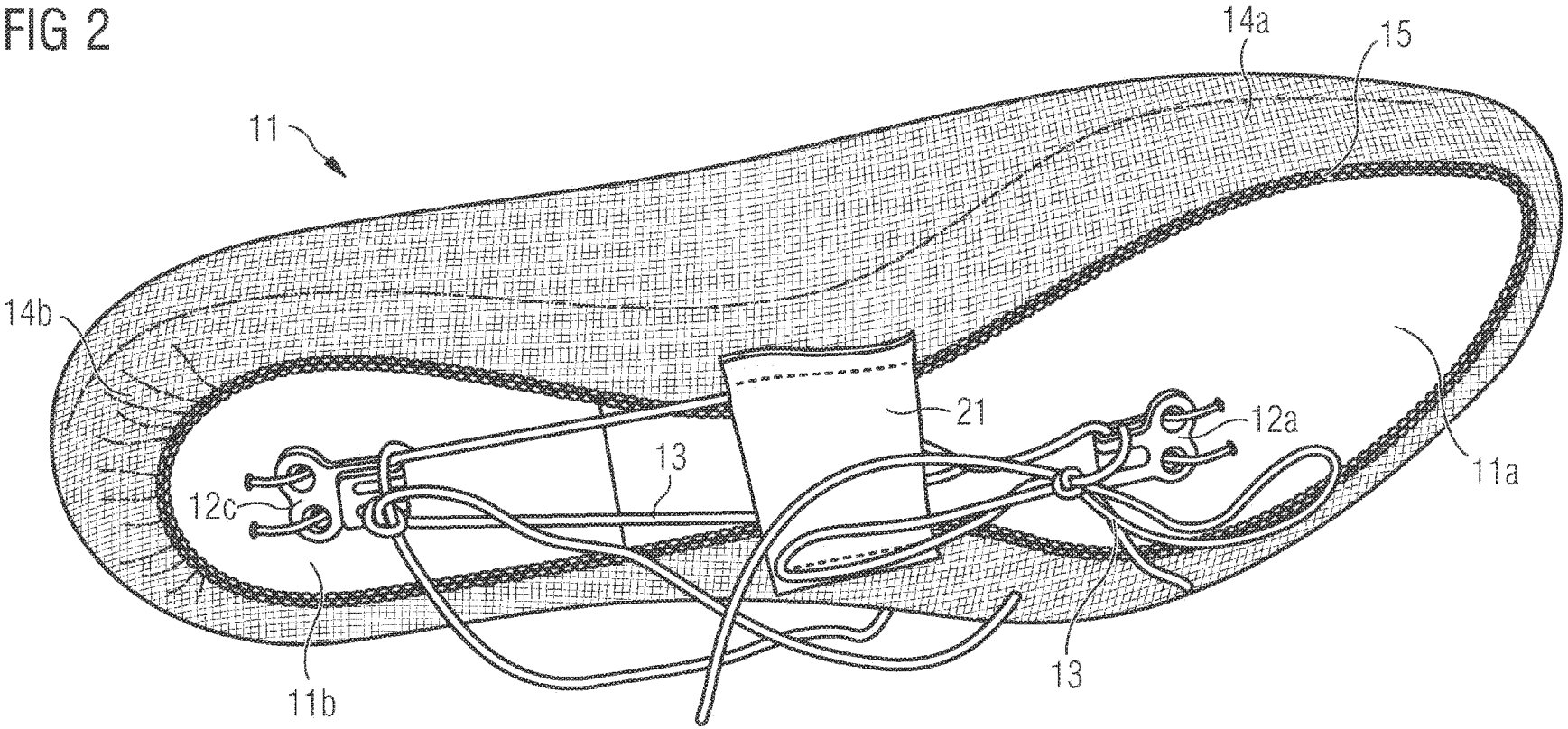
FIG. 2 depicts an example of a lasted upper having a bridge on a last with two fasteners for attaching string according to some embodiments.

FIG. 2 shows an example of a lasted upper 14 on a last 11. The last 11 is extended and includes two parts 11*a* and 11*b* connected by a hinge. In the example of FIG. 2, the fasteners 12 (respectively identified as 12*a* and 12*b* in FIG. 2) are hooks. The depicted last 11 includes two hooks, one hook on each of its two connected parts 11*a* and 11*b*. Each hook may be attached to the upper 11, e.g., by nails. Strings 13 originating from a heel region 14*b* of the upper 14 are attached to the fastener or hook on the first part 11*a* of the last and strings 13 originating from a toe region 14*a* of the upper 14 are attached to the fastener or hook in the second part 11*b* of the last. In other words, strings 13 originating from one side of the upper 14 are attached at the fastener at the opposite side of the last. The strings 13 are arranged in a channel 15 sewn into a rim of the upper. This way, tension may be transmitted by the string uniformly along the length of the channel 15 which allows a particularly good fit of the upper 14 to the last 11 to be achieved. The channel 15 is arranged substantially along the whole length of the rim of the upper 14. Substantially along the whole length of rim of the upper in this context may signify along the whole length of the rim of the upper but excluding the space around the openings to insert a string. The space may be sufficiently large to insert and remove a string 13, e.g. using a needle attached to the string 13. In some embodiments, the openings to insert the string 13 into the channel 15 are in a midfoot region of the upper 14.

Alternatively, the upper 14 could include a string 13 that is incorporated into a rim portion around the gap on the bottom portion of the upper 14. Incorporating the string 13 into a rim portion of the upper 14 may be simpler and faster than inserting the string 13 into a channel 15, especially for a knitted upper, and thus reduce the time required for lasting the upper. Incorporating the string into a rim portion of the upper 14 in this context may signify that the yarn is not placed in a channel 15, as described herein, after forming said channel 15. Though the string 13 is incorporated into the upper 14, it may still be possible to move the string 13 relative to the upper 14 by pulling on the string 13. For some methods of producing the upper 14, it is possible to incorporate such a string 13 into the upper 14 directly when the upper 14 is being manufactured. For example, the string 13 may be incorporated as a filler yarn in warp knitting or weft knitting.

The upper 14 shown in FIG. 2 includes a bridge 21 connecting a left side and a right side of the upper 14. The bridge 21 is arranged in a midfoot portion of the last, where the last has a concave shape. The bridge 21 is made from a sheet of material, which could be the same material as the material from which the upper 14 is made. In some embodiments, the bridge 21 is made from an elastic material. The purpose of the bridge 21 may be to pull together the left and right opposite parts of the upper 14 in the concave region of the upper 14, where a tight fit of the upper 14 to the last 11 is otherwise difficult to achieve. The inventors have found that the lasting of the upper 14 is improved, if the bridge 21 is made from a sheet of material rather than a single string or a plurality of strings. In particular, the connection between the two opposite sides may be stronger if the bridge is made from a sheet of material rather than a single string or a plurality of strings. Furthermore, the bridge 21 may be sewn into the upper quickly in a process that can easily be automated.

Figure 3:
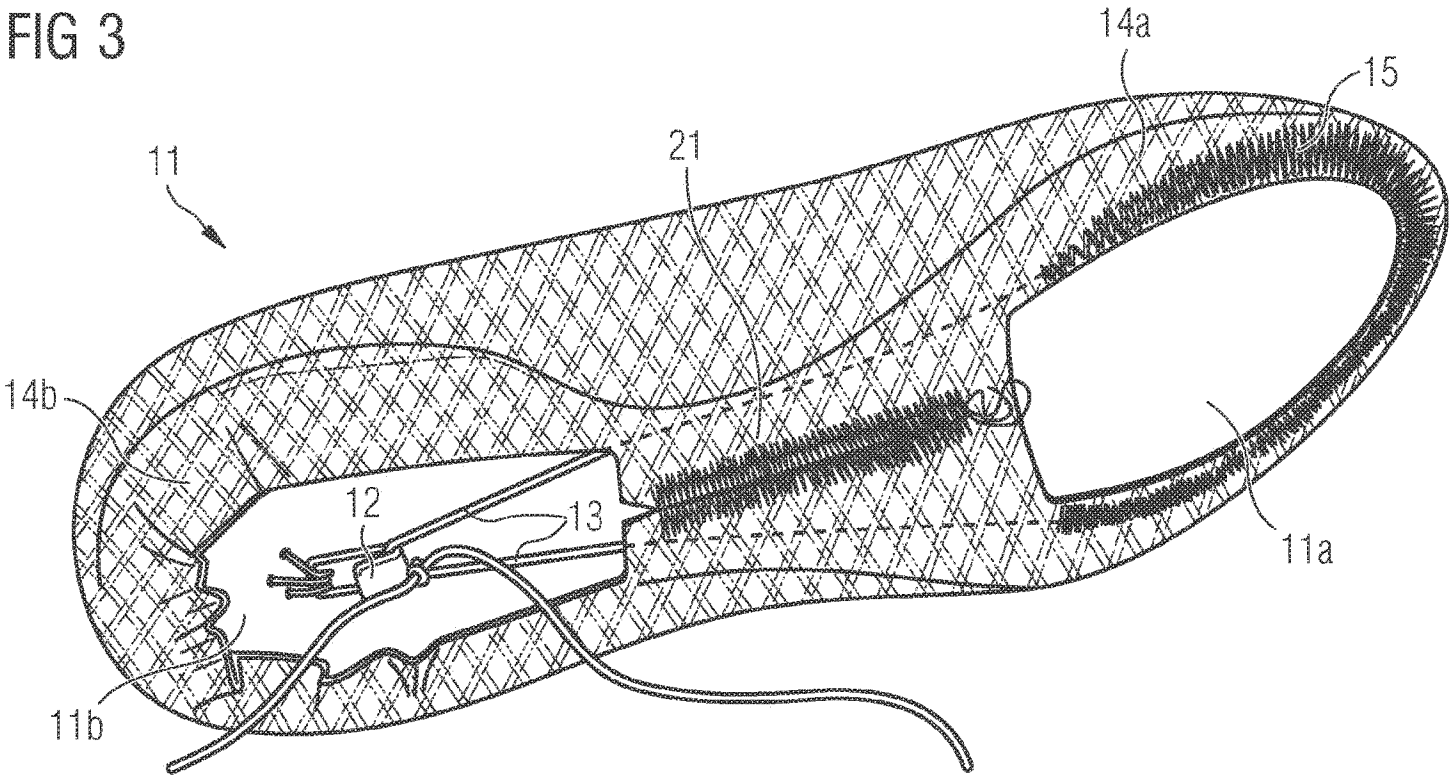
FIG. 3 depicts an example of a lasted upper having a bridge on a last with one fastener for attaching string according to some embodiments.

FIG. 3 shows another example of a lasted upper 14 on a last 11. The upper 14 in FIG. 3 includes a bridge 21 made from the same material as the upper. The bridge includes a left side and right side. Each side of the bridge 21 may be formed together with the upper. The left and the right side of the bridge may be stitched together in the middle. The bridge may facilitate a tight fit of the upper 14 to the last 11 in the concave midfoot region. The bridge may be especially useful in this context since only a single fastener is present on the last 11 in FIG. 3. The last 11 includes a first part 11*a* and a second part 11*b* connected by a hinge (not shown in FIG. 3). The last 11 in FIG. 3 includes a single fastener or hook 12 attached in a heel portion of the last 11. A string 13 is guided through a channel 15 included in a toe region 14*a* of the upper 14. Since the string 13 is attached on the second part 11*b* in the heel portion of the last, the string pulls the upper in the forefoot region, when the tension over the fastener or hook 12 is tightened.

Figure 4:
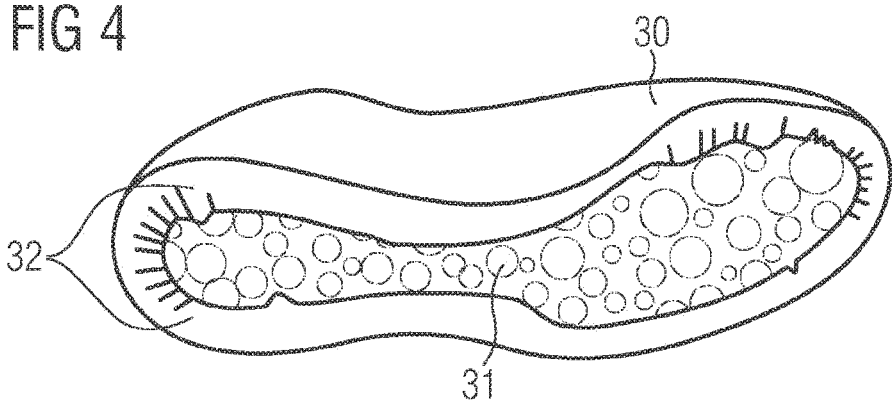
FIG. 4 depicts a conventional board lasted upper.

FIG. 4 shows for comparison an upper 30 that is board lasted according to a method known in the prior art. An upper is glued around the rim 32 of a lasting board 31. The lasting board is typically attached to the last during the lasting operation. This process requires a lot of skill and is labor intensive. Furthermore, the resulting article of footwear is heavy due to the extra weight of the lasting board. Another problem with board-lasted footwear is that the fit of the upper 30 to a wearer's foot close to the rim 32 is often not ideal, e.g., leading to the formation of wrinkles and a reduced wearing comfort. The insole is usually connected to the upper by a seam (not shown). An additional disadvantage of board-lasted footwear is that the seam connecting the insole and the upper is usually a weak point, which can tear easily.

Figure 5A:
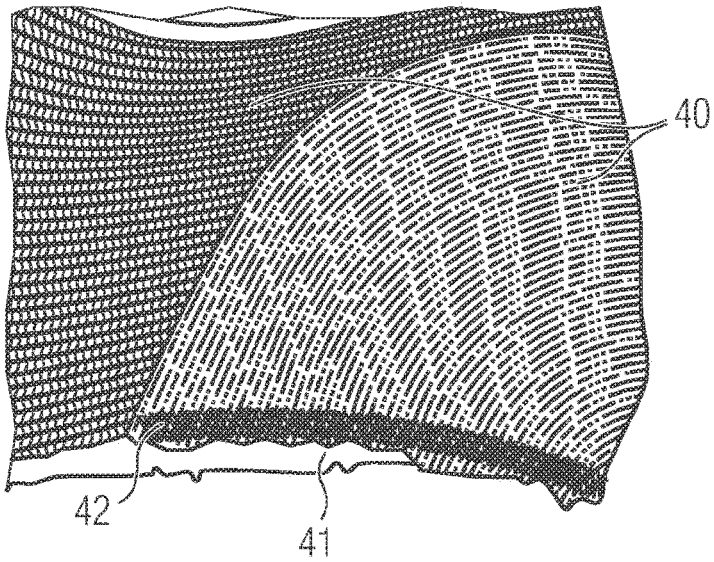
FIG. 5A and FIG. 5B depict a conventional sewn upper.
Figure 5B:
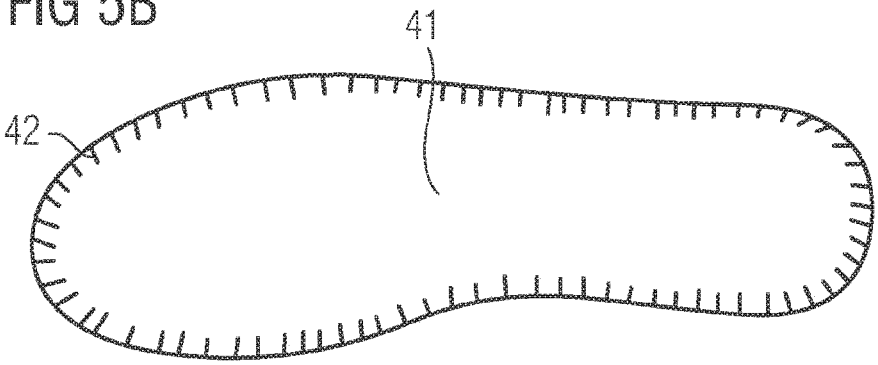

FIGS. 5A and 5B show for comparison an upper 40 sewn at a seam 42 with an insole sheet 41 as known in the prior art. Typically the insole sheet 41 is sewn to the upper 40 by a Strobel sewing machine. The insole sheet is then glued to a sole element of the article of footwear. FIG. 5A shows a side view of the upper 40 while FIG. 5B shows a top view. A disadvantage of this method is that the upper 40 needs to be pre-formed in a separate step before it may be sewn to the insole sheet 41. Furthermore, with this method it is not possible to attach the upper 40 directly to the outsole, but instead an additional insole sheet 41 is required, which adds to the weight of the shoe.

Figure 6A:
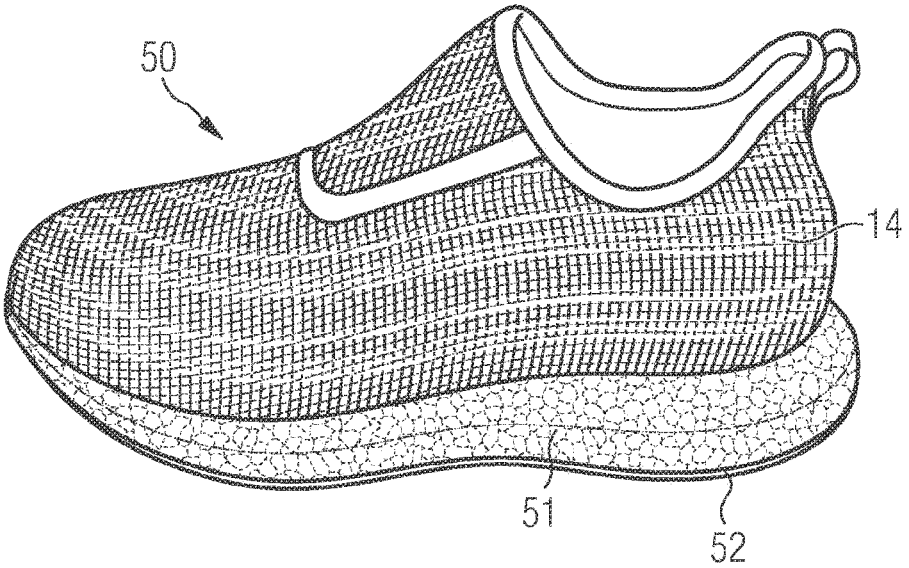
FIG. 6A and FIG. 6B depict an example of a shoe produced according to some embodiments.
Figure 6B:
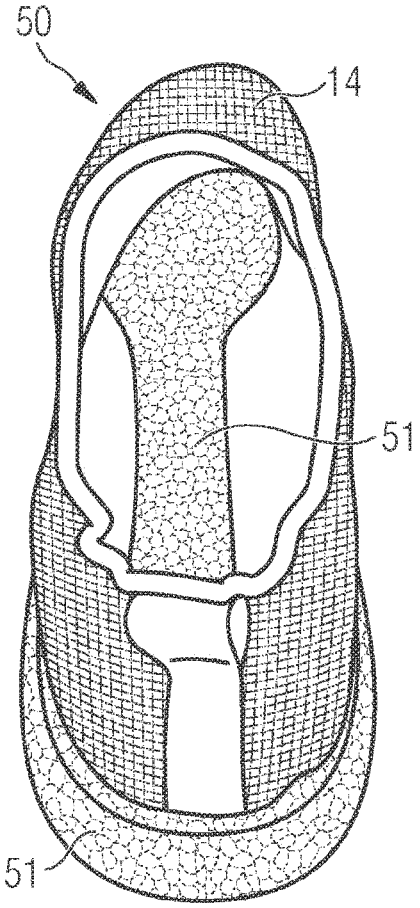

FIGS. 6A and 6B show an example of an article of footwear 50 including an upper 14 lasted with the method according to some embodiments described herein. FIG. 6A shoes a side view of the article of footwear while FIG. 6B shows a top view. The article of footwear 50 includes an upper 14, lasted with the method according some embodiments described herein. The article of footwear 50 further includes a midsole 51 and an outsole 52. The person skilled in the art will recognize that the article of footwear 50 could include just the upper 14 and the outsole 52, in which case it is particularly lightweight. Alternatively, an outsole 52 could be omitted and its function could be provided by just the midsole 51.

The midsole 51 may be attached to the upper by welding, for example infrared welding, which may allow a sole element to be attached without the use of additional adhesives. Therefore, the environmental impact of the production process may be improved. Furthermore, since the seal is made directly between the material of the sole element and the upper, the seal is waterproof, long-lasting, and does not affect the properties of the sole element as, for example, a hardened adhesive might do. The midsole 51 additionally or alternatively could be attached to the upper 14 by an adhesive.

In FIGS. 6A and 6B, the midsole 51 includes a cushioning element made from a plurality of randomly arranged particles of expanded material. A sole element 51 including a plurality of randomly arranged particles of an expanded material may provide excellent cushioning and breathability properties as channels may be formed between the particles of expanded material through which air and/or a liquid can travel. The cushioning element may further include a reinforcing element provided as a foil, e.g., including thermoplastic urethane. The foil may include at least one opening which is arranged in such a way that air and/or a liquid passing through the at least one channel between the particles of expanded material can pass in at least one direction through the at least one opening in the foil. This arrangement may allow both the stability of the sole element to be improved and the breathability to be controlled and improved. For example, the sole element may be designed to be impermeable to water from the ground but to let moisture pass through the sole from a wearer's foot.

A benefit of the method according to some embodiments may be that the upper 14 may be attached in such a way to the midsole 51, or even directly to the outsole 52, that the midsole 51, or even the outsole 52, is directly visible on the inside of the footwear (see FIG. 6B). As well as allowing for interesting design effects, this has several technical advantages. An additional insole element may be superfluous in some embodiments, thus reducing the weight of the article of footwear and simplifying the construction of said article of footwear. Furthermore, the breathability of the article of footwear may be improved as less material may be required to support the sole construction. Due to the superior cushioning properties of a cushioning element based on randomly arranged particles of an expanded material, the wearing comfort of such an article of footwear may be excellent.

In the following, further examples are described to facilitate the understanding of the invention:

EXAMPLE 1

A method of lasting an upper (14) for an article of footwear, comprising:

(a) providing a last, wherein the last (11) comprises at least two parts that can be moved relative to each other such as to allow the last (11) to be collapsed along a substantially longitudinal direction, wherein the last (11) comprises at least one means (12) for attaching a string (13) configured to hold the string (13) in a collapsed and in an extended state of the last (11);

(b) providing an upper (14);

(c) inserting the collapsed last (11) into the upper (14);

(d) attaching the upper (14) to the means (12) for attaching a string (13) using at least one string (13); and (e) extending the last (11).

EXAMPLE 2

The method according to the preceding example, wherein step (d) is performed before step (e).

EXAMPLE 3

The method according to one of the preceding examples, wherein the string (13) is attached to the upper (14) in step (d) in such a way that it is under tension when the last (11) is in an extended state.

EXAMPLE 4

The method according to one of the preceding examples, wherein the upper (14) comprises at least one gap on a bottom portion of the upper (14).

EXAMPLE 5

The method according to the preceding example, wherein the upper (14) further comprises a bridge (21) connecting a left side and a right side of the upper (14) on the bottom portion of the upper (14), thereby bridging the gap, wherein the bridge (21) is formed by a sheet of material.

EXAMPLE 6

The method according to example 4 or 5, wherein the upper (14) further comprises a channel (15) located in a rim portion around the gap with at least two openings to the channel (15) configured in such a way as to allow a string (13) to be inserted into the channel (15) and pulled through the channel (15) along the length of the channel (15).

EXAMPLE 7

The method according to one of the preceding examples, further comprising arranging the upper (14) on the last (11) in a tight and formfitting manner by pulling the string (13).

EXAMPLE 8

The method according to one of the preceding examples, further comprising forming a margin with the upper (14) on the lower side of the last (11).

EXAMPLE 9

The method according to the preceding example, wherein the margin extends at least 5 mm from the rim of the last (11) at any position around the rim.

EXAMPLE 10

The method according to one of the preceding examples, wherein the method is performed in an automated fashion.

EXAMPLE 11

The method according to the preceding example, wherein the automation comprises handling the last (11) and/or the upper (14) with a robot arm.

EXAMPLE 12

The method according to the preceding example, wherein the action of the robot arm is based on information gained from a visual control system comprising at least one camera.

EXAMPLE 13

The method according to one of the preceding examples, wherein the means for collapsing the last (11) comprises a hinge.

EXAMPLE 14

The method according to one of the preceding examples, wherein the last (11) comprises at least two means (12) for attaching a string (13).

EXAMPLE 15

The method according to the preceding example, wherein at least one means (12) for attaching a string (13) is arranged on each part of the last (11).

EXAMPLE 16

The method according to one of the preceding examples, wherein the means (12) for attaching a string (13) comprises a hook and/or a pin.

EXAMPLE 17

The method according to one of the preceding examples, wherein the means (12) for attaching a string (13) is arranged on the last (11) in such a way that it does not protrude from the surface of the last (11).

EXAMPLE 18

The method according to one of the preceding examples, wherein the last (11) can be collapsed along a longitudinal direction such as to reduce its length by at least 3 cm.

EXAMPLE 19

A method of producing an article of footwear, comprising:

(a) providing a lasted upper (14) according to one of the preceding examples, (b) providing a sole element, (c) attaching the sole element to the upper (14).

EXAMPLE 20

The method according to the preceding example, where the sole element forms substantially the entire sole of the article of footwear.

EXAMPLE 21

The method according one of examples 19 or 20, wherein the steps (b) and (c) comprise injecting a substantially liquid component into a form, attaching said form to the lasted upper (14), and curing the component.

EXAMPLE 22

The method according to the preceding example, wherein the substantially liquid component comprises thermoplastic polyurethane.

EXAMPLE 23

The method according to example 19 or 20, wherein the sole element comprises a cushioning element comprising a plurality of randomly arranged particles of an expanded material.

EXAMPLE 24

The method according to example 19, 20, or 23, wherein the sole element is attached to the upper (14) by welding.

EXAMPLE 25

The method according to example 19, 20, or 23, wherein the sole element is attached to the upper (14) by means of an adhesive.

EXAMPLE 26

The method according to one of examples 19 to 25, wherein the surface of the last (11) is treated with a non-stick substance.

EXAMPLE 27

The method according to one of examples 19 or 21 to 26, wherein the sole element is a cushioning element and/or a midsole element and the method further comprises the additional step of attaching an outsole to the sole element.

EXAMPLE 28

An article of footwear, produced according to the method of one of examples 19 to 27.

EXAMPLE 29

A collapsible last, comprising:

(a) at least two parts, that can be moved relative to each other along a substantially longitudinal direction such as to allow the last (11) to be collapsed along the substantially longitudinal direction, (b) at least one means (12) for attaching a string (13) configured to hold the string (13) in a collapsed and in an extended state of the last.

EXAMPLE 30

The last (11) according to the preceding example, wherein the means for collapsing the last (11) comprises a hinge.

EXAMPLE 31

The last (11) according to one of examples 29 or 30, wherein the last (11) comprises at least two means (12) for attaching a string (13).

EXAMPLE 32

The last (11) according to the preceding example, wherein at least one means (12) for attaching a string (13) is arranged on each part of the last.

EXAMPLE 33

The last (11) according to one of examples 29 to 32, wherein the means (12) for attaching a string (13) comprises a hook and/or a pin.

EXAMPLE 34

The last (11) according to one of examples 29 to 33, wherein the last (11) comprises a non-stick portion on its bottom surface.

EXAMPLE 35

The last (11) according to one of examples 29 to 34, wherein the means (12) for attaching a string (13) is arranged on the last (11) in such a way that it does not protrude from the surface of the last.

EXAMPLE 36

An upper (14) comprising at least one gap on a bottom portion of the upper (14), a bridge (21) connecting a left side and a right side of the upper (14) on the bottom portion of the upper (14), thereby bridging the gap, wherein the bridge (21) is formed by a sheet of material.

EXAMPLE 37

The upper (14) according to the preceding example, further comprising a channel (15) around the gap with at least two openings to the channel (15) configured in such a way as to allow a string (13) to be inserted into the channel (15) and pulled through the channel (15) along the length of the channel (15).

EXAMPLE 38

The upper (14) according to example 36, further comprising a string (13) that is incorporated into a rim portion around the gap on the bottom portion of the upper (14).

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A lasting system, comprising:

a collapsible last, comprising:

at least two parts movable relative to each other along a substantially longitudinal direction so as to allow the last to be collapsed along the substantially longitudinal direction to a collapsed state of the last from an extended state of the last; and at least one fastener; and at least one string attached with the at least one fastener and held by the at least one fastener in the collapsed state of the last and in the extended state of the last.

2. The lasting system according to claim 1, wherein the last comprises a hinge to facilitate movement between the collapsed state and the extended state.

3. The lasting system according to claim 1, wherein the at least one fastener comprises at least two fasteners.

4. The lasting system according to claim 3, wherein at least one of the at least two fasteners is arranged on each part of the last.

5. The lasting system according claim 1, wherein the at least one fastener comprises a hook or a pin.

6. The lasting system according to claim 1, wherein the last comprises a non-stick portion on a bottom surface of the last.

7. The lasting system according to claim 1, wherein the last is collapsible along a longitudinal direction so as to reduce a length of the last by at least 3 cm.

8. The lasting system according to claim 1, wherein the at least one fastener is configured to hold the string during transition between the collapsed state of the last and the extended state of the last.

9. A method comprising:

inserting the collapsible last in the collapsed state into a footwear upper attaching the upper to the at least one fastener using the at least one string; and extending the last.

10. The method according to claim 9, wherein the attaching is performed before the extending.

11. The method according to claim 9, wherein the attaching comprises attaching the at least one string to the upper in such a way that the at least one string is under tension when the last is in the extended state.

12. The method according to claim 9, wherein the upper comprises:

at least one gap on a bottom portion of the upper; and a bridge connecting a left side and a right side of the upper on the bottom portion of the upper, thereby bridging the gap, wherein the bridge is formed by a sheet of material.

13. The method according to claim 12, wherein the upper further comprises a channel located in a rim portion around the gap with at least two openings to the channel configured in such a way as to allow the at least one string to be inserted into the channel and pulled through the channel along the length of the channel.

14. The method according to claim 9, further comprising arranging the upper on the last in a tight and formfitting manner by pulling the at least one string.

15. The method according to claim 9, wherein the extending the last increases an amount of tension in the at least one string so as to draw the upper about the last.

16. The method according to claim 9, further comprising forming a margin with the upper on a lower side of the last, wherein the margin extends at least 5 mm from a rim of the last at any position around the rim.

17. The method according to one of claim 9, wherein the method is performed via automation.

18. The method according to claim 17, wherein the automation comprises handling at least one of the last or the upper with a robot arm; and wherein the action of the robot arm is based on information gained from a visual control system comprising at least one camera.

19. The method of claim 9, further compromising:

providing a sole element; and attaching the sole element to the upper.

20. The method according to claim 19, wherein the sole element forms substantially an entire sole of an article of footwear.

21. The method according claim 19, wherein the providing the sole element and the attaching the sole element to the upper comprise:

injecting a substantially liquid component into a form;

attaching said form to the upper;

and curing the component.

22. The method according claim 21, wherein the substantially liquid component comprises thermoplastic polyurethane.

23. The method according to claim 19, wherein the sole element:

comprises a cushioning element comprising a plurality of randomly arranged particles of an expanded material;

is attached to the upper by welding; or is attached to the upper by an adhesive.

24. The method according to claim 19, wherein the sole element is at least one of a cushioning element or a midsole element; and wherein the method further comprises attaching an outsole to the sole element.

* * * * *